US010409198B2

(12) United States Patent
Shirayanagi

(10) Patent No.: US 10,409,198 B2
(45) Date of Patent: Sep. 10, 2019

(54) FEEDING SCREW AND DEVELOPING DEVICE

(71) Applicant: CANON KABUSHIKI KAISHA, Tokyo (JP)

(72) Inventor: Jun Shirayanagi, Ushiku (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/982,040

(22) Filed: May 17, 2018

(65) Prior Publication Data

US 2018/0335724 A1 Nov. 22, 2018

(30) Foreign Application Priority Data

May 22, 2017 (JP) ..... 2017-100861

(51) Int. Cl.
*G03G 15/08* (2006.01)

(52) U.S. Cl.
CPC ..... *G03G 15/0891* (2013.01); *G03G 15/0877* (2013.01); *G03G 2215/083* (2013.01); *G03G 2215/0822* (2013.01); *G03G 2215/0827* (2013.01)

(58) Field of Classification Search
CPC ..... G03G 15/0891; G03G 2215/0827
See application file for complete search history.

(56) References Cited

U.S. PATENT DOCUMENTS 9,201,346 B2 * 12/2015 Sako ..... G03G 15/0891
9,348,262 B1 * 5/2016 Suenami ..... G03G 15/0889
2005/0123321 A1 * 6/2005 Buhay-Kettelkamp ..... G03G 15/0822 399/254
2006/0222409 A1 * 10/2006 Yamagishi ..... G03G 15/0891 399/254
2008/0260430 A1 10/2008 Sakamoto et al.
2010/0226689 A1 * 9/2010 Mihara ..... G03G 15/0875 399/254
2010/0290814 A1 * 11/2010 Morimoto ..... G03G 15/0875 399/254

(Continued)

FOREIGN PATENT DOCUMENTS

JP H09-120201 A 5/1997
JP 2010-256429 A 11/2010

OTHER PUBLICATIONS

European Search Report dated Nov. 21, 2018, in related European Patent Application No. 18171995.6.

*Primary Examiner* — Ryan D Walsh
(74) *Attorney, Agent, or Firm* — Venable LLP

(57) ABSTRACT

A feeding screw for feeding a developer includes a rotation shaft, and a helical blade provided on the rotation shaft and including a plurality of threads. The helical blade includes a first blade helically formed with a single thread on the rotation shaft, a second blade helically formed with a single thread on the rotation shaft, and a third blade helically formed with a single thread on the rotation shaft. With respect to a direction along the rotation shaft, a gap is provided between a downstream end portion of the second blade and an upstream end portion of the third blade. A volume of the second blade is not more than 75% of the first blade between an upstream end portion of the second blade and the upstream end portion of the third blade with respect to the direction.

42 Claims, 9 Drawing Sheets

(56) References Cited

U.S. PATENT DOCUMENTS

| | | | | |
|---|---|---|---|---|
| 2012/0014719 | A1* | 1/2012 | Hayashi | G03G 15/0853 399/254 |
| 2012/0195646 | A1* | 8/2012 | Eck | G03G 15/0889 399/267 |
| 2012/0201573 | A1 | 8/2012 | Watanabe et al. | |
| 2014/0193176 | A1 | 7/2014 | Nakajima et al. | |
| 2014/0235415 | A1* | 8/2014 | Nakajima | F16C 13/00 492/35 |
| 2015/0132027 | A1* | 5/2015 | Kashimoto | G03G 15/0891 399/254 |
| 2016/0216640 | A1* | 7/2016 | Nose | G03G 15/0891 |
| 2017/0269505 | A1 | 9/2017 | Ariizumi et al. | |
| 2017/0343928 | A1 | 11/2017 | Shirayanagi | |
| 2018/0129149 | A1* | 5/2018 | Yamaguchi | G03G 15/0812 |

* cited by examiner

FEEDING SCREW AND DEVELOPING DEVICE

FIELD OF THE INVENTION AND RELATED ART

The present invention relates to a feeding screw including blades with a plurality of threads and relates to a developing device including the feeding screw.

In an image forming apparatus using an electrophotographic type, an electrostatic latent image formed on a photosensitive drum is developed as a toner image by a developing device. As the developing device, a developing device using a two-component developer containing toner and a carrier has been conventionally used. In the case of the developing device using the two-component developer, the developer accommodated in a developing container is fed by a screw while being stirred by the screw.

As the screw for feeding the developer while stirring the developer, a constitution in which two blades each helically formed with a single thread around a rotation shaft are provided and each of the two blades (two threads) is provided with a discontinuous portion where the blade (thread) is discontinuous in an axial direction of the rotation shaft has been proposed (Japanese Laid-Open Patent Application (JP-A) 2010-256429).

As disclosed in JP-A 2010-256429, in the case where each of the two blades (two threads) is provided with the discontinuous portion, there is a possibility that a feeding property of the developer cannot be sufficiently ensured. That is, in the case of the constitution disclosed in JP-A 2010-256429, it would be considered that the discontinuous portions provided to the two blades (threads) are merely different in phase from each other and are formed so as to cut away associated blade portions in the same volume. For this reason, a developer stirring property is improved. However, when the blade includes the discontinuous portion, an area of the blade contributing to feeding of the developer decreases, and therefore, the feeding property of the developer lowers. In the case of the constitution disclosed in JP-A 2010-256429, each of the blades similarly lowers in developer feeding property, and therefore, there is a possibility that the developer feeding property of the screw cannot be sufficiently ensured.

SUMMARY OF THE INVENTION

A principal object of the present invention is to provide a feeding screw and a developing device which are capable of compatibly realizing ensuring of a developer feeding property and a developer stirring property.

According to an aspect of the present invention, there is provided a feeding screw for feeding a developer comprising: a rotation shaft; and a helical blade provided on the rotation shaft and including a plurality of threads, wherein the helical blade includes, a first blade helically formed with a single thread on the rotation shaft, a second blade helically formed with a single thread on the rotation shaft, and a third blade helically formed with a single thread on the rotation shaft, wherein with respect to a direction along the rotation shaft, a gap is provided between a downstream end portion of the second blade and an upstream end portion of the third blade, and wherein a volume of the second blade is not more than 75% of the first blade between an upstream end portion of the second blade and the upstream end portion of the third blade with respect to the direction.

Further features of the present invention will become apparent from the following description of exemplary embodiments with reference to the attached drawings.

DESCRIPTION OF EMBODIMENTS

First Embodiment

Figure 1:
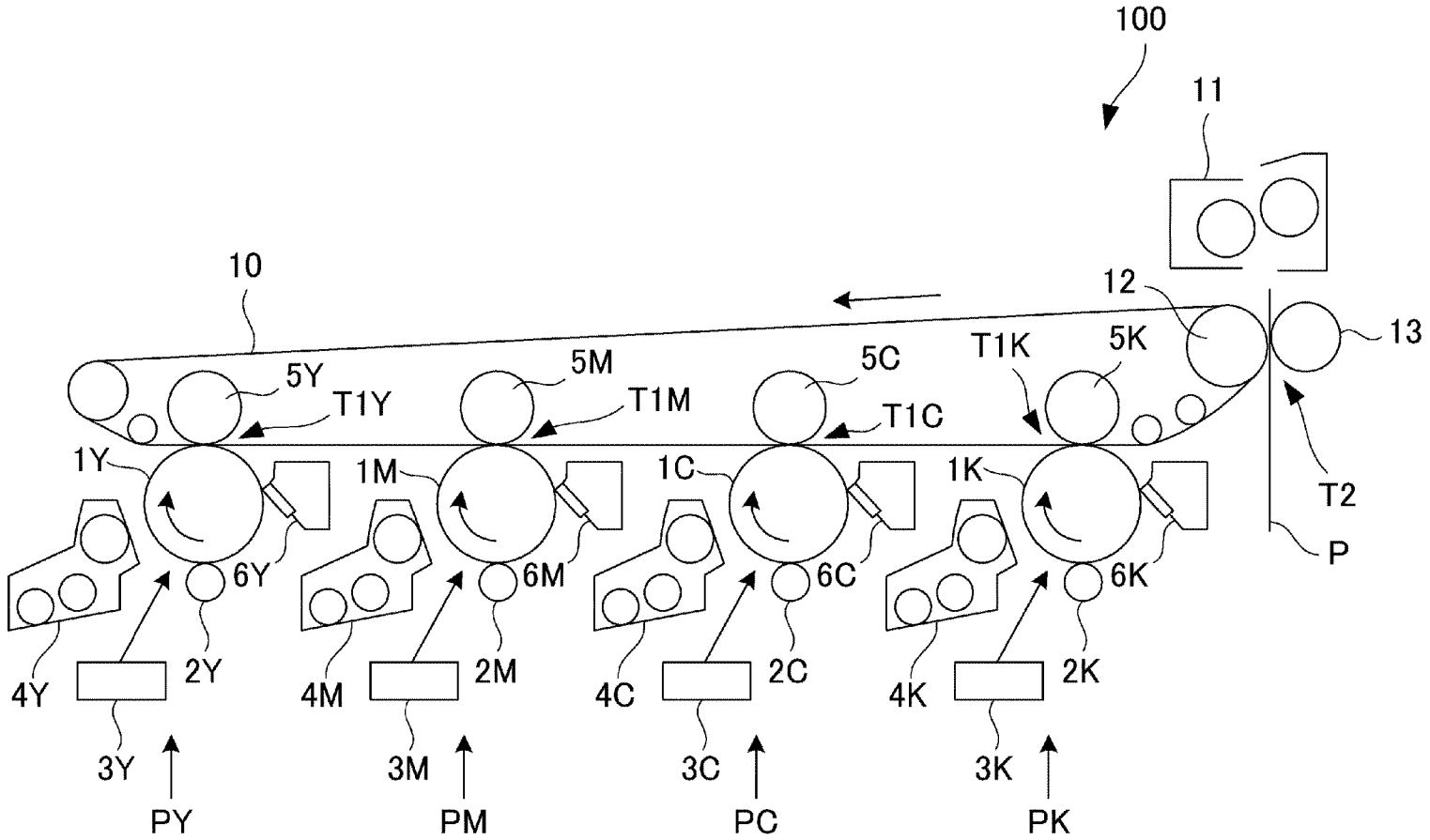
FIG. 1 is a schematic view of an image forming apparatus in a First Embodiment.

The First Embodiment will be described with reference to FIGS. 1 to 7. First, a general structure of an image forming apparatus in this embodiment will be described using FIG. 1.

[Image Forming Apparatus]

An image forming apparatus 100 is an electrophotographic full-color printer including four image forming portions PY, PM, PC and PK provided corresponding to four colors of yellow, magenta, cyan and black, respectively. In this embodiment, the image forming apparatus 100 is of a tandem type in which the image forming portions PY, PM, PC and PK are disposed along a rotational direction of an intermediary transfer belt 10 described later. The image forming apparatus 100 forms a toner image (image) on a recording material P depending on an image signal from a host device such as an original reader (not shown) communicatably connected with an image forming apparatus main assembly or a personal computer communicatably connected with the image forming apparatus main assembly. As the recording material P, it is possible to cite sheet materials such as a sheet, a plastic film and a cloth.

An outline of such an image forming process will be described. First, in the respective image forming portions PY, PM, PC and PK, toner images of the respective colors are formed on photosensitive drums 1Y, 1M, 1C and 1K, respectively. The thus formed color toner images are transferred onto the intermediary transfer belt 10 and then are transferred from the intermediary transfer belt 10 onto the recording material P. The recording material P on which the toner images are transferred is fed to a fixing device 11, in which the toner images are fixed on the recording material P. This will be described specifically below.

The four image forming portions PY, PM, PC and PK provided in the image forming apparatus 100 are substantially the same except that colors of developers are different from each other. Accordingly, in the following, as a representative, the image forming portion PY will be described, and constituent elements of other image forming portions are represented by replacing a suffix "Y", added to reference numerals or symbols of these in the image forming portion PY, with "M", "C" and "K", respectively, and will be omitted from description.

In the image forming portion PY, as an image bearing member, a cylindrical photosensitive member, i.e., the photosensitive drum 1Y is provided. The photosensitive drum 1Y, for example, 30 mm in diameter, 360 mm in length with respect to a longitudinal direction (rotational axis direction) and 250 mm/sec in process speed (peripheral speed), and is rotationally driven in an arrow direction in FIG. 1. At a periphery of the photosensitive drum 1Y, a charging roller 2Y (charging device), a developing device 4Y, a primary transfer roller 5Y and a cleaning device 6Y are provided. Below the photosensitive drum 1Y in the figure, an exposure device (laser scanner) 3Y is provided.

The charging roller 2Y is, for example, 14 mm in diameter and 320 mm in length with respect to the longitudinal direction and is rotated by the photosensitive drum 1Y during image formation. The charging roller 2Y is urged toward the photosensitive drum 1Y by an urging spring (not shown). Further, to the charging roller 2Y, a charging bias (for example, DC voltage: −900 V, AC peak-to-peak voltage: 1500 V) is applied from a high-voltage source. As a result, the photosensitive drum 1Y is electrically charged substantially uniformly by the charging roller 2Y.

Further, the intermediary transfer belt 10 is disposed opposed to the photosensitive drums 1Y, 1M, 1C and 1K. The intermediary transfer belt 10 is stretched by a plurality of stretching rollers and is circulated and moved in an arrow direction by drive of an inner secondary transfer roller 12 also functioning as a driving roller. At a position opposing the inner secondary transfer roller 12 through the intermediary transfer belt 10, an outer secondary transfer roller 13 as a secondary transfer member is provided, and constitutes a secondary transfer portion T2 where the toner image is transferred from the intermediary transfer belt 10 onto the recording material P. On a side downstream of the secondary transfer portion T2 with respect to a recording material feeding direction, the fixing device 11 is disposed.

A process for forming the image by the image forming apparatus 100 constituted as described above will be described. First, when an image forming operation is started, a surface of the rotating photosensitive drum 1Y is electrically charged uniformly by the charging roller 2. Then, the photosensitive drum 1Y is exposed to laser light emitted from the exposure device 3Y and corresponding to an image signal. As a result, an electrostatic latent image corresponding to the image signal is formed on the photosensitive drum 1Y. The electrostatic latent image on the photosensitive drum 1Y is visualized by the toner accommodated in the developing device 4Y and thus is formed in a visible image (toner image).

The toner image formed on the photosensitive drum 1Y is primary-transferred onto the intermediary transfer belt 10 at a primary transfer portion T1Y constituted between the photosensitive drum 1Y and the intermediary transfer belt 10 sandwiched by the primary transfer roller 5Y and the photosensitive drum 1Y. Toner (transfer residual toner) remaining on the surface of the photosensitive drum 1Y after primary transfer is removed by the cleaning device 6Y.

Such an operation is successively performed also in the respective image forming portions for magenta, cyan and black, so that the resultant four color toner images are superposed on the intermediary transfer belt 10. Thereafter, the recording material P accommodated in a recording material accommodating cassette (not shown) is fed to the secondary transfer portion T2 in synchronism with timing of toner image formation, and the four color toner images are secondary-transferred together from the intermediary transfer belt 10 onto the recording material P. Toner remaining on the intermediary transfer belt 10 which cannot be completely transferred at the secondary transfer portion T2 is removed by an unshown intermediary transfer belt cleaner.

Then, the recording material P is fed to the fixing device 11. The toners (toner images) on the recording material P are melted and mixed under application of heat and pressure, and are fixed as a full-color image on the recording material P. Thereafter, the recording material P is discharged to an outside of the image forming apparatus. As a result, a series of image forming processes is ended. Incidentally, by using only desired image forming portion(s), it is also possible to form an image of a desired signal color or images of desired plurality of colors.

[Developing Device]

Next, the developing device 4Y will be described using FIGS. 2 and 3. Incidentally, also the developing devices 4M, 4C and 4K are similarly constituted. The developing device 4 includes a developing container 41 accommodating a two-component developer containing a non-magnetic toner and a magnetic carrier. The developing container 41 opens at a portion of a developing region opposing the photosensitive drum 1Y, and a developing sleeve 44 as a developer carrying member in which a magnet roller 44*a* is non-rotatably provided is provided so as to be partly exposed at an opening of the developing container 41.

Figure 2:
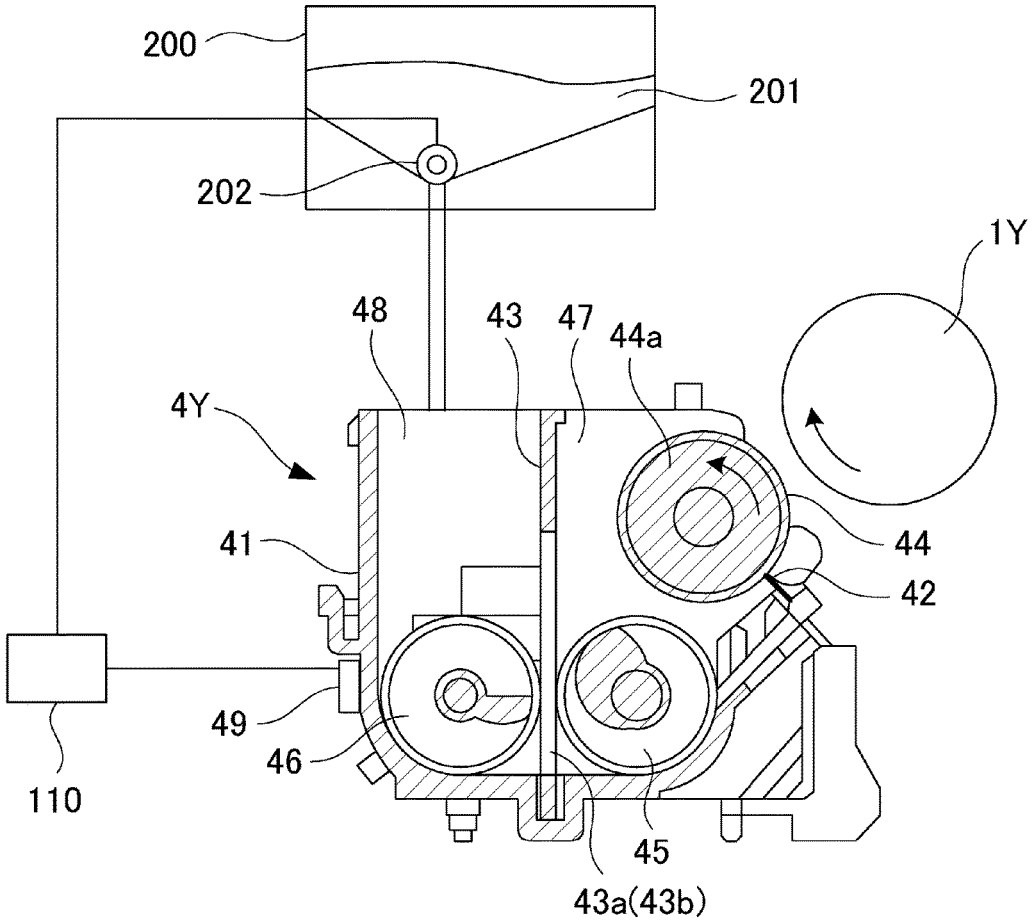
FIG. 2 is a schematic view of a developing device according to the First Embodiment.
Figure 3:
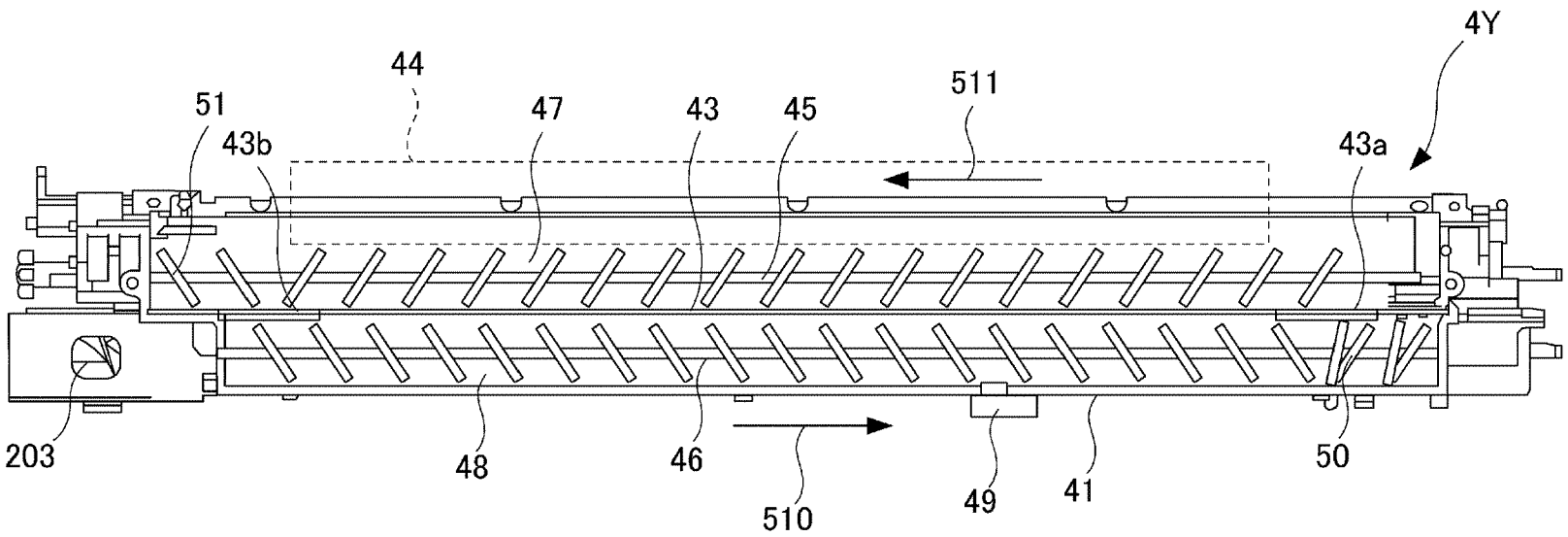
FIG. 3 is a top (plan) view showing the developing device according to the First Embodiment in a partly simplified manner.

In this embodiment, the developing sleeve 44 is constituted by a non-magnetic material, and for example, is 20 mm in diameter and 334 mm in longitudinal length, and is rotated in an arrow direction in FIG. 2 at a process speed (peripheral speed) of 250 mm/sec. The magnet roller 44*a* as a magnetic field generating means includes a plurality of magnetic poles along a circumferential direction, and by a magnetic field generated by the magnetic roller 44*a*, the developer is carried on the surface of the developing sleeve 44.

A layer thickness of the developer carried on the surface of the developing sleeve 44 is regulated by a regulating blade 42, so that a thin layer of the developer is formed on the surface of the developing sleeve 44. The developing sleeve 44 feeds the developer formed in the thin layer to the developing region while carrying the developer. In the developing region, the developer on the developing sleeve 44 is erected and forms a magnetic chain. In this embodiment, the magnetic chain is contacted to the photosensitive drum 1Y, and the toner of the developer is supplied to the photosensitive drum 1Y, so that the electrostatic latent image is developed as the toner image. At this time, in order to improve developing efficiency, i.e., a toner imparting ratio to the latent image, to the developing sleeve 44, a developing bias voltage in the form of a DC voltage biased with an AC voltage is applied from a voltage (power) source. The developer after the latent image is developed with the developer is collected in a developing chamber 47, described later, in the developing container 41 with rotation of the developing sleeve 44.

An inside of the developing container 41 is partitioned into the developing chamber 47 as a first chamber and a stirring chamber 48 as a second chamber by a partition wall 43 extending in a vertical direction. On both end sides of the partition wall 43 with respect to a longitudinal direction (rotational axis direction of the developing sleeve 44), communication ports 43*a* and 43 for establishing communication between the developing chamber 47 and the stirring chamber 48 are formed. As a result, a developer circulating path is formed by the developing chamber 47 and the stirring chamber 48.

Further, in the developing container 41, a first screw 45 as a first feeding portion for feeding the developer while stirring the developer and a second screw 46 as a second feeding portion for feeding the developer while stirring the developer are provided. The first screw 45 is disposed in the developing chamber 47 and feeds the developer accommodated in the developing chamber 47 in an arrow 511 direction (first direction) in FIG. 3 while stirring the developer, and supplies the developer to the developing sleeve 44. The second screw 46 is disposed in the stirring chamber 48 and feeds the developer accommodated in the stirring chamber 48 in an arrow 510 direction (second direction opposite to the first direction) in FIG. 3 while stirring the developer.

Above the developing device 4Y, a hopper 200 as a developer supplying device accommodating a supply developer 201 consisting only of the toner or consisting of the toner and the magnetic carrier is provided as shown in FIG. 2. In the hopper 200, a supplying screw 202 is provided and is capable of supplying the toner, in an amount corresponding to an amount of the toner used for image formation, from the hopper 200 to the inside of the developing container 41 through a supply opening 203 (FIG. 3). A supply amount of the developer is adjusted by a number of rotations of the supplying screw 202 by a controller 110 as a control means.

The controller 110 carries out not only control of the supplying screw 202 but also control of an entirety of the image forming apparatus 100. Such a controller 110 includes a CPU (central processing unit), a ROM (read only memory) and a RAM (random access memory). The CPU carries out control of respective portions while reading a program corresponding to a control procedure stored in the ROM. Further, in the RAM, operation data and input data are stored, and the CPU carries out control by making reference to the data stored in the RAM, on the basis of the above-described program or the like.

The developing device 4Y includes a toner content sensor 49 as a density detecting means capable of detecting a toner content (proportion of a weight of toner particles to a total weight of carrier particles and the toner particles, T/D ratio) in the developing container 41. The toner content sensor 49 is provided to the stirring chamber 48 and detects the toner content in the stirring chamber 48. In this embodiment, as the toner content sensor 49, an inductance sensor is used, and a sensor surface (detecting surface) of the inductance sensor is exposed to the inside of the stirring chamber 48. The inductance sensor detects permeability in a predetermined detection range through the sensor surface. When the toner content of the developer changes, also the permeability due to a mixing ratio between the magnetic carrier and the non-magnetic toner changes, and therefore, the change in permeability is detected by the inductance sensor, so that the toner content can be detected.

The controller 110 determines a supply amount of the developer from the hopper 200 on the basis of a result of detection of the toner content in the developing container 41 by the toner content sensor 49. Incidentally, a toner image (patch image) for control is formed on the photosensitive drum 1Y or the intermediary transfer belt 10, and a density (content) of the patch image is detected by an unshown sensor, and then a detection result thereof is reflected in the above-described supply amount in some cases. This sensor includes, for example, a light-emitting portion and a light-receiving portion, and detects the density of the patch image by receiving, at the light-receiving portion, reflected light of light emitted from the light-emitting portion toward the patch image. Further, also in some cases, the controller 110 reflects a video count value in the above-described supply amount. The video count value is a value obtained by integrating a level (for example, 0-255 levels) per (one) pixel of an inputted image data in an amount corresponding to one image screen.

[Circulation of Developer]

Next, circulation of the developer in the developing container 41 will be described. The first screw 45 and the second screw 46 are disposed substantially in parallel to each other along the rotational axis direction of the developing sleeve 44. The first screw 45 and the second screw 46 feed the developer in opposite directions along the rotational axis direction of the developing sleeve 44. Thus, the developer is circulated in the developing container 41 through the communication points 43*a* and 43*b* by the first screw 45 and the second screw 46.

That is, by a feeding force of the first screw 45 and the second screw 46, the developer, on the developing sleeve 44, in which the toner is consumed in a developing step and the toner content lowers is collected in the developing chamber 47 and is fed to the stirring chamber 48 through the communication port 43*b*, and then moves in the stirring chamber 48. Further, also the developer, in the developing chamber 47, which is not coated on the developing sleeve 44 moves in the developing chamber 47 and then moves into the stirring chamber 48 through the communication port 43*b*.

Here, on a side upstream of the communication port 43*b* of the stirring chamber 48 with respect to the developer feeding direction of the second screw 46, is the supply opening 203 through which the developer is supplied from the hopper 200. For this reason, in the stirring chamber 48, the developer fed from the developing chamber 47 through the communication port 43*b* and the supply developer 201 supplied from the hopper 200 through the supply opening 203 are fed by the second screw 46 while being stirred by the second screw 46. Then, the developer fed by the second screw 46 is moved to the developing chamber 47 through the first communication port 43*a*.

[Developer]

Here, the two-component developer used in this embodiment will be described. As the developer, the developer obtained by mixing a negatively chargeable non-magnetic toner and a positively chargeable magnetic carrier is used. The non-magnetic toner is obtained by adding from powder of titanium oxide, silica or the like to a surface of powder prepared by incorporating a colorant, a wax component and the like into a resin material such as polyester or styrene-acrylic resin and then by subjecting a resultant mixture to pulverization or polymerization. The magnetic carrier is obtained by subjected, to resin coating, a surface layer of a core formed with ferrite particles or resin particles kneaded with magnetic powder. The content of the toner in the developer in an initial state is 8%-10%, for example.

[Stirring Property and Feeding Property of Developer]

Next, a stirring property and a feeding property of the developer by the second screw for feeding the developer in the stirring chamber will be described. To the stirring chamber, the supply developer is supplied as described above, and therefore, the second screw is required to compatibly realize the stirring property and the feeding property of the developer. First, the stirring property will be described.

In order to faithfully develop, with the toner, the electrostatic latent image formed on the photosensitive drum, it is desired that a charge amount of the toner in the developing container is stabilized. The charged amount of the toner has a tendency that the charge amount of the toner depends on the toner content (T/D ratio) of the developer. That is, when the toner content of the developer is excessively high, the toner charge amount becomes low, and when the toner content of the developer is excessively low, the toner is excessively charged electrically. With an increasing toner charge amount, an amount of the toner used for developing the latent image on the photosensitive drum becomes small, and therefore, when the toner charge amount causes non-uniformity, density non-uniformity generates on the toner image on the photosensitive drum.

Further, the toner is charged by friction with the carrier, and therefore, when the toner content of the developer is locally high in the developing container, a coating ratio of the toner to the carrier becomes excessively high, so that the toner charge amount is insufficient. As a result, toner flying (fog) to a non-image portion on the photosensitive drum, toner scattering to an outside of the developing container and the like can occur.

Further, due to an increase in toner charge amount or the like, when a bulk of the developer becomes high, the supply developer is not readily taken within a rotation radius region of the screw. For this reason, the supply developer is fed while sliding on the developer which has already existed in the developing container, so that the supply developer reaches the developing chamber while being satisfactorily stirred and thus can be scooped by the developing sleeve in some cases.

The toner content of the developer immediately after the supply developer is supplied is high, but on the other hand, the toner is consumed by the developing sleeve and thus the toner content of the developer collected in the developing container is low. Accordingly, it is desired that the above-described developers different in toner content are quickly stirred and mixed and thus the toner content of the developer in the developing container is stabilized.

Next, the feeding property of the developer will be described. In order to supply, to the developing sleeve, the toner in the same amount as a toner consumption amount proportional to an output image density, it is desired that a feeding speed of the developer is maintained by the screw at a level not less than a predetermined speed. When the developer feeding speed is slow, in the case where images with a high image density are continuously formed, a time until the supplied developer reaches the developing sleeve becomes large (slow). Then, the toner content of the developer scooped by the developing sleeve lowers, so that the image density gradually becomes thick. For this reason, it is desired that the supplied developer is caused to quickly reach the developing sleeve by ensuring the developer feeding speed at a level not less than a predetermined speed. Thus, the second screw for feeding the developer immediately after being supplied is desired to compatibly realize ensuring of the developer stirring property and ensuring of the developer feeding property.

[Single Thread Screw]

Figure 4:
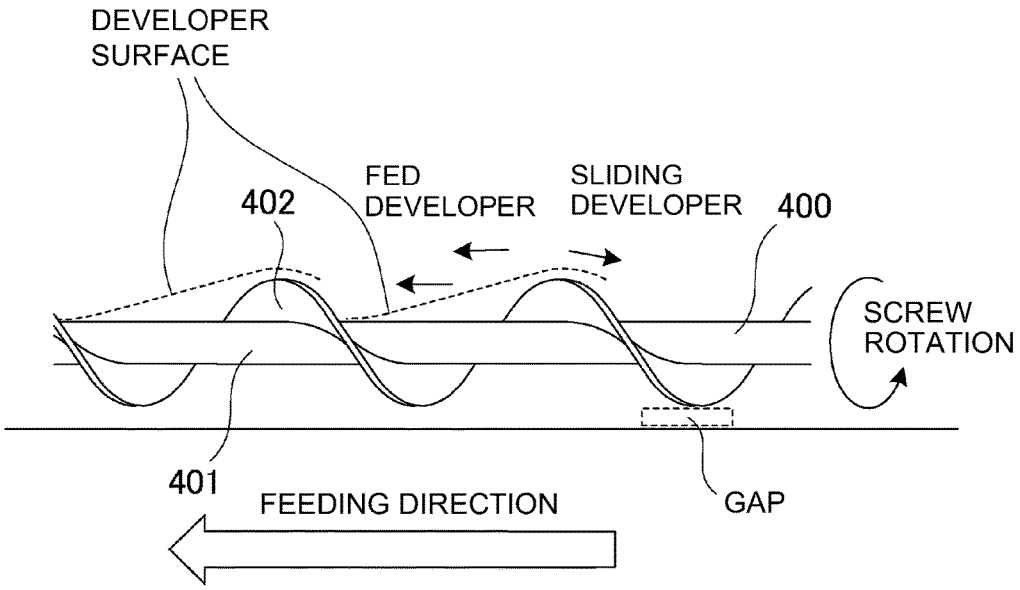
FIG. 4 is a schematic view for illustrating a developer feeding property of a single thread screw.
Figure 5:
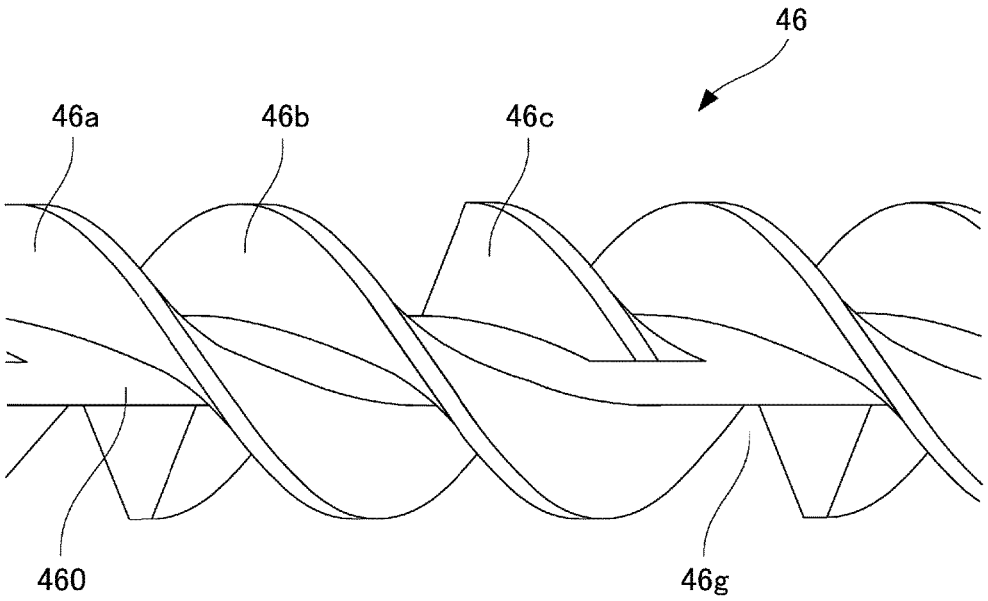
FIG. 5 is a schematic view showing a part of a second screw according to the First Embodiment.

Next, the developer feeding property in the case where a single thread feeding screw 400 shown in FIG. 4 is used as the screw for feeding the developer in the developing container will be described. The feeding screw 400 includes a single thread blade 402 helically formed around a rotation shaft 401. The developer is fed with rotation of the feeding screw 400 about the rotation shaft 401. In FIG. 5, a broken line on the feeding screw 400 represents a surface of the developer.

The developer between adjacent portions of the blade 402 of the feeding screw 400 is fed so as to be pushed out by rotation of the blade 402. The developer fed by being pushed out is fed in a distance equal to a screw pitch, per (one) rotation of the feeding screw 400. On the other hand, a part of the developer slides on the blade 402 on an upstream side of the feeding direction or stagnates in a gap between the blade 402 and an inner wall of the developing container, so that the developer feeding speed becomes slow.

In order to increase the developer feeding speed of the feeding screw 400, it is required that developer feeding efficiency of the feeding screw b400 is enhanced. That is, it is desired that an amount of the developer which slides on the blade 402 or which stagnates in the gap is decreased as small as possible, and thus an amount of the developer moved is the distance equal to the screw pitch by the rotation of the feeding screw 400.

However, the developer feeding efficiency of the feeding screw 400 is enhanced, most of the developer between the adjacent portions of the blade 402 is fed without being satisfactorily stirred.

For example, in the case where the feeding screw is prepared as a multi-thread screw including a plurality of blades provided with threads, the developer feeding property is easily ensured, but the developer stirring property lowers, so that as described above, the toner charge amount causes non-uniformity in the developing container.

Particularly, in the case where the amount of the developer accommodated in the developing container is decreased by downsizing the developing device, it is difficult to compatibly realize ensuring of the developer feeding property and ensuring of the developer stirring property. For example, in the case where the developing device is downsized, it would be considered that an outer diameter of the feeding screw is decreased, but in the case, an area in which the developer is pushed by the blade is decreased, and therefore, the developer feeding property of the feeding screw is liable to lower. For this reason, it would be considered that the developer feeding property is enhanced by forming the feeding screw in the multi-thread screw, but in this case, the developer stirring property lowers.

[Second Screw of this Embodiment]

Therefore, in this embodiment, each of the first screw 45 and the second screw 46 is prepared in the form of the multi-thread screw including the plurality of blades provided with threads. Further, as regards the second screw 46 for feeding the developer in the stirring chamber 48, of the plurality of blades (threads), at least one blade (thread) is provided with a gap portion where the blade (thread) is discontinuous. In the following, the second screw 46 will be specifically described with reference to FIGS. 5 to 7.

As shown in FIG. 5, the second screw 46 includes a rotation shaft 460 and includes, at a periphery of the rotation shaft 460, a plurality of blades 46*a*, 46*b* and 46*c* provided with threads. On a side downstream of the second screw 46 with respect to a developer feeding direction (second direction), a returning screw 50 for feeding the developer in a direction opposite to the developer feeding direction (second direction) of the second screw 46 is provided so as to be continuous to a downstream end portion of the second screw 46 (FIG. 3). Incidentally, on an upstream side of the second screw 46 with respect to the developer feeding direction, is a screw for feeding, into the stirring chamber 48, the developer supplied from a supply opening 203. In this embodiment, the second screw 46 is a three-thread screw including three blades 46*a*, 46*b* and 46*c* provided with threads. Further, of the plurality of blades 46*a*, 46*b* and 46*c*, the blades 46*a* and 46*b* as the first blade provided with at least one thread (two threads in this embodiment) have a continuous shape over an axial direction of the rotation shaft 460. Incidentally, in this embodiment, a constitution in which the blades 46*a* and 46*b* are continuous over the axial direction is employed, but a constitution in which the blades 46*a* and 46*b* are partly removed may also be employed.

On the other hand, the blade 46*c* as the second blade (third blade) which is different from the first blade and which is provided with at least one thread (single thread in this embodiment) has a shape including a gap portion 46*g* in which the blade 46*c* is discontinuous on at least a part of the rotation shaft 460 with respect to the axial direction. As a result, a constitution in which the helical blade is provided on each of both sides of the gap portion 46*g* is employed. That is, a part of the blade 46*c* is removed, and this part constitutes the gap portion 46*g*. The three blades 46*a*, 46*b* and 46*c* providing the three threads are formed in the named order with the same outer diameter and the same pitch with respect to the developer feeding direction of the second screw 46.

Incidentally, the first screw 45 is a three-thread screw similarly as the second screw 46, but any of the blades is not provided with the gap portion. On a side downstream of the first screw 45 with respect to the developer feeding direction (first direction), a returning screw 51 for feeding the developer in a direction opposite to the developer feeding direction (first direction) of the first screw 45 is provided so as to be continuous to a downstream end portion of the first screw 45 (FIG. 3). However, also the first screw 45 may be formed in a shape such that at least one of the blades (threads) is provided with the gap portion similarly as in the case of the second screw 46. Further, the first screw 45 may preferably be the screw including the three blades 46*a*, 46*b* and 46*c* (i.e., including the three threads) similarly as the second screw 46. That is, the first screw 45 may preferably be the screw which has the outer diameter, the pitch and the number of threads which are the same as those of the second screw 46, and in this case, the gap portion may be provided similarly as in the case of the second screw 46 and may also be not provided.

Further, the second screw 46 is constituted so that a volume of one thread of the blade 46*c* of the second screw 46 with respect to the axial direction of the second screw 46 is not more than 75% of a volume of one thread of the blade 46*a* (or the blade 46*b*) with respect to the axial direction of the second screw 46. On the other hands, in the case the blade 46*c* has a continuous shape over the axial direction, the volume of the blade 46*c* is made not more than 75% of a volume of the blade having this shape. When the blade 46*c* and the gap portion constitute one pitch, even in a constitution in which a volume of the blade 46*a* and the volume of the blade 46*c* in that region are compared with each other, the above-described relationship is satisfied. Further, in the case where the volume of the gap portion 46*g* is a volume of a phantom blade portion formed in the gap portion 46*g* on assumption that the blade 46*c* has the continuous shape, the volume of the gap portion 46*g* is not less than 25% of a sum of the volume of the gap portion 46*g* and the volume of the blade 46*c*. That is, a volume ratio obtained by dividing the volume of the gap portion 46*g* occupied in an entire region of the second screw 46 with respect to the axial direction, by the volumes of the blade 46*c* and the gap portion 46*c* occupied in the entire region with respect to the axial direction is made not less than 25%. Incidentally, the volumes of the blade and the gap portion referred to herein are a volume of an entirety of the second screw 46 for feeding the developer in the second direction. Accordingly, the volume of the blades of the second screw 46 does not include a volume of the returning screw 50 provided upstream of the second screw 46 and a volume of the screw, provided upstream of the second screw 46, for feeding the supplied developer into the stirring chamber 48.

Particularly, in this embodiment, the volume of the blade 46*c* is made not more than 50% of the volume of the blade 46*a* (or the blade 46*b*). Even in this case, when the blade 46*c* and the gap portion constitute one pitch, even in a constitution in which the volume of the blade 46*a* and the volume of the blade 46*c* in that region are compared with each other, the above-described relationship is satisfied. In other words, a volume ratio obtained by dividing the volume of the gap portion 46*g* by the volumes of the blade 46*c* and the gap portion 46*g* is made not less than 50%.

The blade 46*c* of the second screw 46 includes the gap portions 46*g* formed periodically over an entire area of the blade 46*c* with respect to the axial direction. In this embodiment, the blade 46*c* and the gap portion 46*g* are disposed so as to alternately exist every 90° with respect to a phase of the second screw 46 along a rotational direction of the second screw 46.

Accordingly, in the case where the portions of the blade 46*c* are viewed from the axial direction in one-full circumference, the blade 46*c* and the gap portion 46*g* alternately exist in the number corresponding to the same phase. Further, an areal ratio between the blade 46*c* and the gap portion 46*g* when the portions of the blade 46*c* are projected in the axial direction through one-full circumference is 1:1. Incidentally, in this embodiment, the phase with respect to the rotational direction was 90°, but a constitution in which the gap portion 46*g* has a predetermined angle (46°-135°) may also be employed.

As a result, the volume of the blade 46*c* is made 50% of the volume of the blade 46*a* (or the blade 46*b*). That is, the blade 46*c* and the gap portion 46*g* are disposed so as to exist in a volume ratio of 1:1 (i.e., each in an amount of 50%). Further, also a volume ratio (volume of gap portion)/{(volume of blade)+(volume of gap portion)} of the gap portion 46*g* per one pitch of the blade 46*c* is 50%. A relational equation of the volume ratio ((volume of gap portion)/{(volume of blade)+(volume of gap portion)} is also applicable when the blade 46*c* and the gap portion constitute one pitch.

Figure 6:
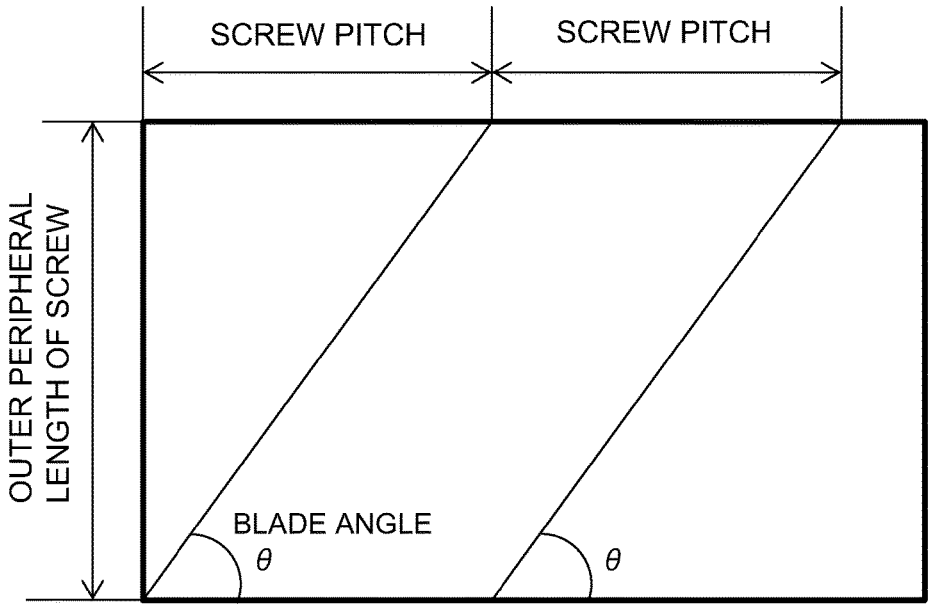
FIG. 6 is a schematic view for illustrating a helix angle of the blade.

Here, FIG. 6 is a schematic view for illustrating an angle of the helical blade, wherein a length of an outer periphery of a circle with a diameter equal to an outer diameter the blade and 46*c* (i.e., a screw outer peripheral length) is the ordinate and a length of the blade 46*c* with respect to an axial direction is the abscissa. An angle formed between a crest of the helical blade and the abscissa is a blade angle θ (helix angle) of the blade 46*c*. In this case, the angle θ of the blade 46*c* is 80° or less. Particularly, the angle θ of the blade 46*c* may preferably be 39° or more and 80° or less, more preferably be 50° or more and 60° or less. Incidentally, also angles θ of the blades 46*a* and 46*b* may preferably be the same as the angle θ of the blade 46*c*.

Further, the outer diameter of the second screw 46 may preferably be 12 mm or more and 20 mm or less, more preferably be 14 mm or more and 17 mm or less. Incidentally, all the blades 46*a*, 46*c* and 46*c* have the same outer diameter, and therefore, the outer diameter of the second screw 46 equals to, for example, the outer diameter of the blade 46*c*. For example, the outer diameters of the blades 46*a*, 46*b* and 46*c* of the second blade 46 are 14 mm, and the pitches of the blades 46*a*, 46*b* and 46*c* of the second blade 46 are 30 mm. As a result, the angle θ of the blade 46*c* is 55.7°.

In such a case of this embodiment, the second screw 46 is formed not only as the three-thread screw but also in a shape such that of the three blades (threads), the two blades (threads) 46*a* and 46*b* have a continuous shape over the axial direction thereof and that the single thread blade 46*c* has a shape including the gap portion 46*g* at a part thereof with respect to the axial direction. For this reason, the developer feeding property can be ensured by the two blades (threads) 46*a* and 46*b*, and the developer stirring property can be ensured by the remaining single blade (thread) 46*c*. That is, of the three blades (threads) 46*a*, 46*b* and 46*c*, the two blades 46*a* and 46*b* (fifth blade) is higher in developer feeding force than the blade 46*c* (sixth blade), and the blade 46*c* is higher in developer stirring force than the blades 46*a* and 46*b*.

Figure 7:
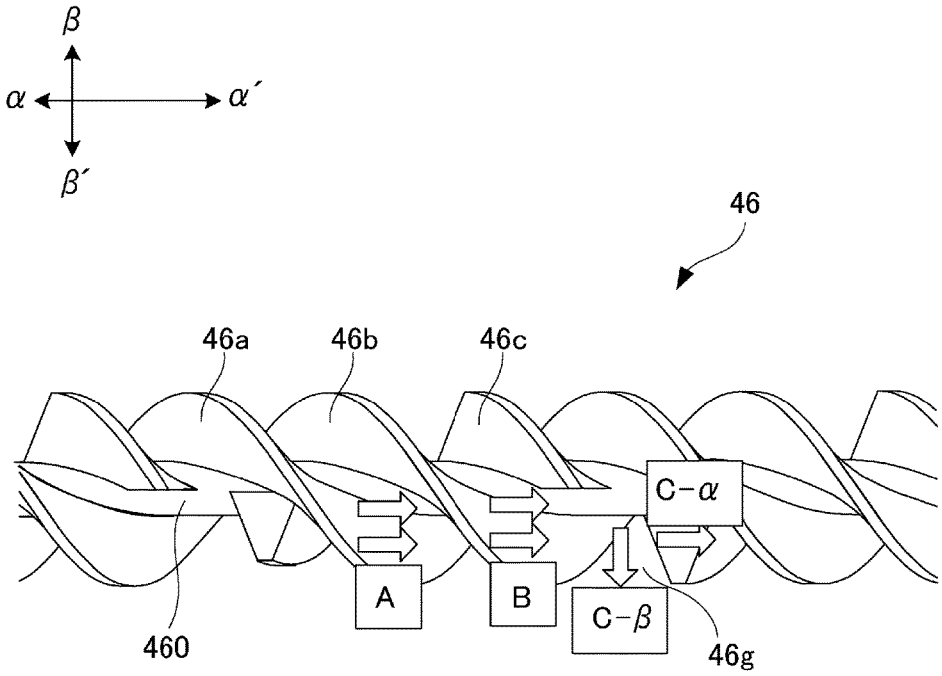
FIG. 7 is a schematic view for illustrating motion of a developer by the second screw according to the First Embodiment.

This will be described using FIG. 7. An a-a' direction shown in FIG. 7 shows a developer feeding direction (arrow 510 direction of FIG. 3) by the second screw 46. On the other hand, a β-β' direction (or β-β' direction) shows a direction in which the developer is stirred by the second screw 46. In an example shown in FIG. 7, the β-β' direction (or β'-β direction) is a direction perpendicular to the α-α' direction.

First, by the continuously and helically formed blades 46*a* and 46*b*, the developer is successively fed in the a-a' direction as indicated by arrows A and then by arrows B. When the developer reaches the helical blade 46*c* including the gap portion 46*g*, the direction of a flow of the developer is divided into an arrow C-a direction (feeding direction) and an arrow C-β direction (stirring direction) by existence of the gap portion 46*g*. Here, in FIG. 11, two arrows A and two arrows B are indicated and on the other hand, a sing arrow C-α and a single arrow C-β are indicated. This is because the division of the flow of the developer is schematically illustrated. Accordingly, the number of these arrows is not intended to mean that the flow of the developer is not necessarily divided with a ratio of 1:1.

On the other hand, in the case where as the second screw, the three-thread screw including the three blades (threads) each provided with no gap portion, at all of the blades (threads), the developer flows as indicated by the arrows A and B, so that the flow of the developer as indicated by the arrow C-β, i.e., the flow of the developer in the stirring direction does not readily generate.

Accordingly, as in this embodiment, as the second screw 46, by using the screw including at least the single thread blade provided with the gap portion 46*g*, components of the flow of the developer in the feeding direction and the stirring direction as shown in FIG. 7 can be easily generated at the gap portion 46*g*. As a result, the developer inside the rotation radius region of the blade 46*c* can be satisfactorily stirred with the developer outside the rotation radius region of the blade 46*c*, so that the stirring property of the supply developer can be improved.

Further, of the three blades (threads) 46*a*, 46*b* and 46*c*, by the blade (thread) 46*c*, the flow of the developer is divided, and therefore, the developer feeding speed locally lowers. However, the developer feeding performance can be ensured by the remaining two blades (threads) 46*a* and 46*b*. For this reason, the developer feeding speed as the entire screw hardly lowers compared with the screw provided with no gap portion and with the same number of threads.

Particularly, in the case of this embodiment, the volume of one thread of the blade 46*c* is not more than 75% of the volume of one thread of the blade 46*a* (or the blade 46*b*). For this reason, the developer stirring property of the second screw 46 is easily improved while sufficiently ensuring the developer feeding property of the second screw 46. That is, in the case where the volume of the blade 46*c* is larger than 75% of the volume of the blade 46*a* (or the blade 46*b*), the volume occupied by the gap portion 46*g* is excessively small, so that a stirring effect by the component portions of the flow of the developer as described above cannot be sufficiently obtained and thus the developer stirring property lowers.

Further, in this embodiment, the second screw 46 is the three-thread screw in which the two blades (threads) 46*a* and 46*b* have the continuous shape along the axial direction and the remaining one blade (thread) 46*c* has the shape including the gap portion 46*g*. In the case of such a constitution, the volume of the blade 46*c* may preferably be not more than 50% of the blade 46*a* (or the blade 46*b*). This is because the developer feeding property is enhanced by the two blades (threads) 46*a* and 46*b*, and therefore, when the volume of the gap portion 46*g* of the remaining one blade (thread) 46*c* is small, the developer stirring property is not readily ensured. According to study by the present inventor, in the case of the second screw 46 as in this embodiment, it turned out that the developer stirring property can be further ensured sufficiently while ensuring the developer feeding property by making the volume of the blade 46*c* not more than 50% of the volume of the blade 46*a* (or the blade 46*b*).

Particularly, in the case of a small-diameter screw such that the outer diameter of the screw is not more than 17 mm, it is preferable that by the three-thread screw as described above, the volume of the blade 46*c* is made not more than 50% of the blade 50*a* (or the blade 50*b*) and the angle θ of the blade 46*c* is made 50° or more and 60° or less. According to study by the present inventor, in the case of the second screw 46 satisfying the conditions, it turned out that the developer stirring property can be further ensured sufficiently while ensuring the developer feeding property.

Thus, the second screw 46 in this embodiment is capable of ensuring the feeding performance in the stirring chamber 48 by forming the blades 46*a* and 46*b* in a continuous shape and is capable of improving the stirring performance while assisting the feeding performance, by providing the blade 46*c* with the gap portion 46*g*. Accordingly, speed-up of the image forming apparatus can be met and the developer in a small amount can be quickly stirred with the supply developer.

Incidentally, in this embodiment, in order to make the volume of the blade 46*c* 50% of the volume of the blade 46*a*, the blade 46*c* and the gap portion 46*g* were periodically disposed alternately every phase of 90°. However, the phases of the blade and the gap portion may also be other than those described above and may also be not required to be periodically disposed. For example, the blade and the gap portion may also be combined every arbitrary phase, or at a part with respect to the developer feeding direction (longitudinal direction), the blade may also be not provided with the gap portion.

Further, in the case where the blade, of the second screw, including the gap portion has a shape such that the gap portion is provided in a part of the region with respect to the axial direction and is not provided in other portions, the gap portion is disposed upstream of at least the toner content sensor 49 with respect to the developer feeding direction of the second screw. In a preferred example, the gap portion is caused to exist immediately upstream of at least the toner content sensor 49 (for example, exist within two pitches of the gap portion-including blade from the upstream end of the sensor surface).

This is because the developer is sufficiently stirred before the developer reaches the toner content sensor 49. That is, in the case where the toner content of the developer which is not sufficiently stirred is detected by the toner content sensor 49, detection accuracy of the toner content in the developing container lowers, so that control of developer supply or the like on the basis of a detection result of the toner content sensor 49 is not readily carried out appropriately. Accordingly, the gap portions may preferably be caused to exist on the side upstream of the toner content sensor 49 so that the developer can be stirred sufficiently before the developer reaches the toner content sensor 49.

In the above-described explanation, the blade 46*c* was 30 mm in pitch which is the same as the pitches of other blades 46*a* and 46*b*, but the blade 46*c* may also have the pitch different from the pitches of the blades 46*a* and 46*b* when the blade 46*c* is disposed in a region sandwiched between the blades 46*a* and 46*b*.

Further, the screw having the constitution including the above-described blades 46*a*, 46*b* and 46*c* may also be applied to the first screw 45, disposed in the developing chamber 47, other than the second screw 46 disposed in the stirring chamber 48. In addition, the screw can also be applied to a screw for feeding the developer while stirring the developer at another portion.

Second Embodiment

Figure 8:
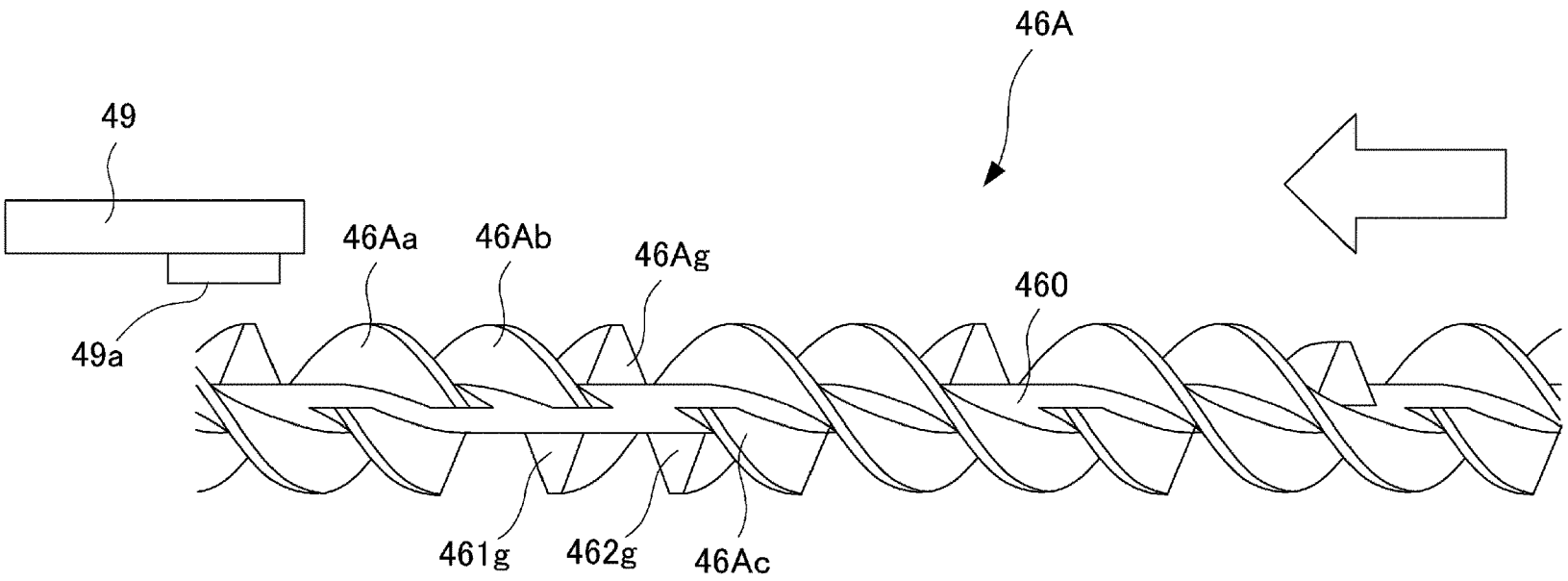
FIG. 8 is a schematic view showing a part of a second screw and a toner content sensor in a Second Embodiment.

The Second Embodiment will be described using FIG. 8 while making reference to FIGS. 2 and 3. A second screw 46A of this embodiment is a screw for feeding the developer in the stirring chamber 48 while stirring the developer similarly as in the First Embodiment and includes three blades (threads) 46Aa, 46Ab and 46Ac helically formed around the rotation shaft 460. However, in the case of this embodiment, different from the First Embodiment, gap portions 461*g* and 462*g* are provided at parts of the blades 46Aa and 46Ab, respectively. Incidentally, the blade 46Ac is provided with a gap portion 46Ag similar to the gap portion 46*g* of the blade 46*c* in the First Embodiment. Other constitution and actions are similar to those in the above-described First Embodiment. In the following, constituent elements similar to those in the First Embodiment will be omitted from description and illustration or will be briefly described, and in the following, a portion different from the First Embodiment will be principally described.

The second screw 46A includes a plurality of blades (threads) 46Aa, 46Ab and 46Ac. Also in this embodiment, the second screw 46A is a three-thread screw including three blades (threads) 46Aa, 46Ab and 46Ac. Further, of these blades (threads) 46Aa, 46Ab and 46Ac, the blades 46Aa and 46Ab as the third blade provided with at least one thread (two threads in this embodiment) have a shape such that the blades 46Aa and 46Ab are provided, at least a part with respect to the axial direction of the rotation shaft 460, with the gap portions 461*g* and 462*g* as a first gap portion where the blades 46Aa and 46Ab are discontinuous. Further, the blade 46Ac as the fourth blade (third blade) which is different from the blades 46Aa and 46Ab and which is provided with at least one thread (single thread in this embodiment) has a shape including a gap portion 46Ag as a second gap portion in which the blade 46Ac is discontinuous on at least a part of the rotation shaft 460 with respect to the axial direction. That is, a part of each of the blades 46Aa, 46Ab and 46Ac is removed, and this part constitutes each of associated gap portions 461*g*, 462*g* and 46Ag. The three blades 46Aa, 46Ab and 46Ac providing the three threads are formed in the named order with the same outer diameter and the same pitch with respect to the developer feeding direction of the second screw 46A.

Further, the second screw 46A is constituted so that a volume of one thread of each of the blades 46Aa and 46Ab is larger than a volume of one thread of the blade 46Ac. That is, the volume of each of the blades 46Aa and 46Ab is larger than the volume of the blade 46Ac.

In the case of this embodiment, the blade 46Ac is similar to the blade 46*c* in the First Embodiment. That is, in the case where the volume of the gap portion 46Ag is a volume of a phantom blade portion formed in the gap portion 46Ag on assumption that the blade 46Ac has the continuous shape, the volume of the gap portion 46Ag is not less than 25% of a sum of the volume of the gap portion 46Ag and the volume of the blade 46Ac.

Further, the blade 46Ac includes the gap portions 46Ag formed periodically over an entire area of the blade 46Ac with respect to the axial direction. In this embodiment, the blade 46Ac and the gap portion 46Ag are disposed so as to alternately exist every 90° with respect to a phase of the second screw 46 along a rotational direction of the second screw 46. Accordingly, an areal ratio between the blade 46Ac and the gap portion 46Ag when the portions of the blade 46Ac are projected in the axial direction through one-full circumference is 1:1.

On the other hand, the blades 46Aa and 46Ab are formed so that the gap portions 461*g* and 462*g* exist on a side upstream of the toner content sensor 49, for detecting the toner content in the stirring chamber 48, with respect to the developer feeding direction (arrow direction) of the second screw 46A. Particularly, in this embodiment, the gap portions 461*g* and 462*g* exist immediately upstream of the toner content sensor 49. The term "immediately upstream" may preferably be within 2 pitches of the blades 46Aa and 46Ab from an upstream end of a sensor surface 49*a* of the toner content sensor 49. In this embodiment, the blades 46Aa and 46Ab are provided with the gap portions 461*g* and 462*g*, respectively, at one position immediately upstream (within one pitch upstream of the sensor surface 49*a*) in a region corresponding to a pitch of 90°.

Thus, in this embodiment, all the helical blades 46Aa and 46Ac including the plurality of threads are provided with the gap portions 461*g*, 462*g* and 46Ag, respectively. However, a volume of each of the gap portions 461*g* and 462*g* is made smaller than a volume of the gap portion 46Ag.

Specifically, the volume of the gap portion 46Ag is not less than 50% (50% in this embodiment) of a volume of the blade 46Ac and the gap portion 46Ac. On the other hand, the volume of the gap portion 461*g* is less than 25% (2.5% in this embodiment) of a volume of the blade 46Aa and the gap portion 461*g*. Similarly, the volume of the gap portion 462*g* is less than 25% (2.5% in this embodiment) of a volume of the blade 46Ab and the gap portion 462*g*. Incidentally, the volume of each of the gap portions is a volume of a phantom blade portion formed at the gap portion on assumption that the blade has a continuous shape.

As a result, similarly as in the First Embodiment, it is possible to compatibly realize ensuring of the developer feeding property and ensuring of the developer stirring property of the second screw 46A. That is, all the blades 46Aa, 46Ab and 46Ac are provided with the gap portions 461*g*, 462*g* and 46Ag, respectively, and therefore, the developer stirring property can be enhanced. On the other hand, in the case where the gap portions of all the blades have the same volume, there is a possibility that the developer feeding property cannot be sufficiently ensured.

On the other hand, in this embodiment, the volume of each of the gap portions 461*g* and 462*g* of the blades 46Aa and 46Ab is made smaller than the volume of the gap portion 46Ag of the blade 46Ac, and therefore, a lowering in developer feeding property of the blades 46Aa and 46Ab can be suppressed. Particularly, the volumes of the gap portions 461*g* and 462*g* are made less than 25% of the volumes of the blade 46Aa and the gap portion 461*g* and of the volumes of the blade 46Ab and the gap portion 462*g*, respectively, and therefore, the developer feeding property of the blades 46Aa and 46Ab can be sufficiently ensured. As a result, the ensuring of the developer feeding property and the ensuring of the developer stirring property of the second screw 46A can be compatibly realized.

Further, the gap portions 461*g* and 462*g* are provided upstream of the toner content sensor 49, and therefore, the developer stirring property can be enhanced on the side upstream of the toner content sensor 49. As a result, detection accuracy of the toner content by the toner content sensor 49 can be improved.

Incidentally, in the above, the blades 46Aa and 46Ab are provided with the gap portions 461*g* and 462*g*, respectively, in a region corresponding to the pitch of 90° with respect to the rotational direction of the second screw 46A. However, the gap portion is not limited thereto, but may also be provided to only either one of the blades 46Aa and 46Ab. Further, positions, phases and periodicity of the gap portions 461*g* and 462*g* with respect to the longitudinal direction can be arbitrarily set when the volume of each of the gap portions 461*g* and 462*g* is smaller than the gap portion 46Ag.

Third Embodiment

Figure 9:
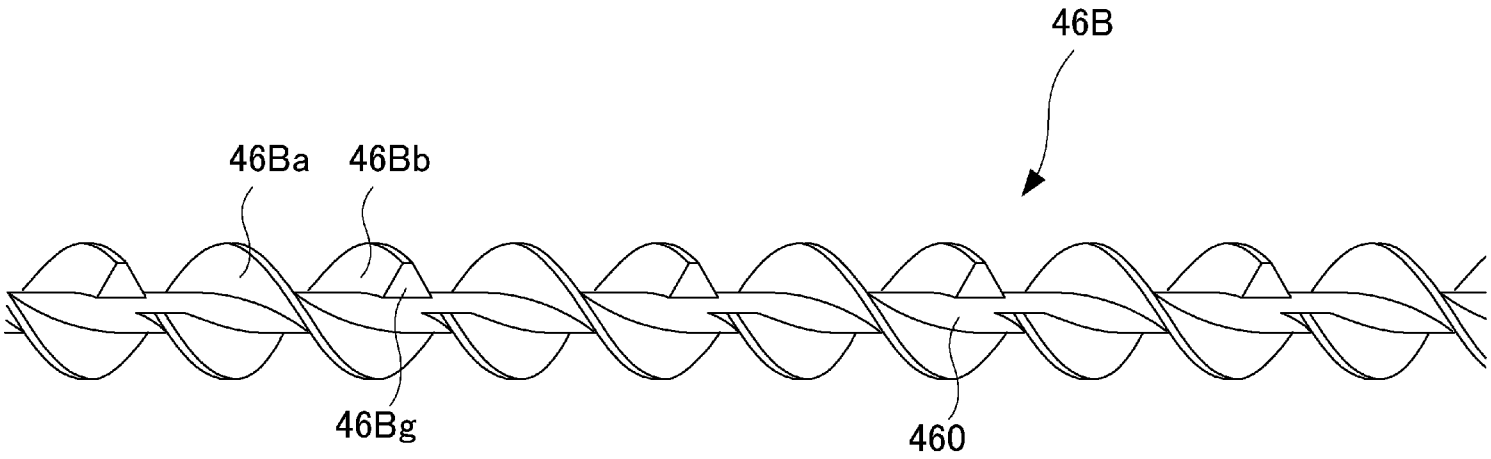
FIG. 9 is schematic view showing a part of a second screw according to a Third Embodiment.

Third Embodiment will be described using FIG. 9 while making reference to FIGS. 2 and 3. A second screw 46B of this embodiment is a screw for feeding the developer in the stirring chamber 48 while stirring the developer similarly as in the First Embodiment. However, different from the First Embodiment, two blades (threads) 46Ba and 46Bb helically formed on the rotation shaft 460 are provided. Other constitution and actions are similar to those in the above-described First Embodiment. In the following, constituent elements similar to those in the First Embodiment will be omitted from description and illustration or will be briefly described, and in the following, a portion different from the First Embodiment will be principally described.

The second screw 46B is a two-thread screw including the two blades (threads) 46Ba and 46Bb. Further, of these blades (threads) 46B and 46Bb, the blade 46B (first blade) has a shape continuous over the axial direction of the rotation shaft 460, and the blade 46Bb (second blade) is provided, at least a part with respect to the axial direction of the rotation shaft 460, with a gap portion 46Bg.

The two blades 46B and 46Bb providing the two threads are formed in the named order with the same outer diameter and the same pitch with respect to the developer feeding direction of the second screw 46B.

Incidentally, in this embodiment, a first screw for feeding the developer in the developing chamber 47 is a two-thread screw similar to the second screw 46B, but either blade is not provided with the gap portion. However, also the first screw may have a shape in which either one of the threads is provided with the gap portion, similarly as in the case of the second screw.

Further, the second screw 46B is constituted so that a volume of the blade 46Bb with respect to the axial direction thereof is not more than 75% (75% in this embodiment) of a volume of the blade 46Ba with respect to the axial direction thereof. When the blade 46*c* and the gap portion provide one pitch, even in a constitution in which a volume of the blade 46*a* in that region is compared with a volume of the blade 46*c* in that region, the above-described relationship is satisfied. In other words, a volume ratio obtained by dividing a volume of the gap portion 46Bg occupied in an entire region of the second screw 46B with respect to the axial direction by a similar volume of the blade 46Bb and the gap portion 46Bg occupied in the entire region of the second screw 46B with respect to the axial direction is made not less than 25% (25% in this embodiment). Incidentally, the volume of the gap portion is a volume of a phantom blade portion formed at the gap portion on assumption that the blade has a continuous shape.

The blade 46Bb of such a second screw 46B is formed so that the gap portion 46Bg is formed periodically over an entire region of the axial direction. In this embodiment, of one-full circumference of the blade 46Bb, the gap portion 46Bg is provided correspondingly to a pitch of 45° and the blade 46Bb is provided correspondingly to a remaining pitch of 135° and these portions are formed periodically over the axial direction. Accordingly, when the portion of the blade 46Bb is projected in the axial direction through one-full circumference, an area ratio between the blade 46Bb and the gap portion 46Bb (blade: gap portion) is 3:1. A volume ratio of the gap portion 46Bg per (one) pitch in the blade 46Bb (i.e., (volume of gap portion)/{(volume of blade)+(volume of gap portion)} is 25%. When the blade 46*a* and the gap portion provide one pitch, even in the constitution in which the volume of the blade 46*a* in that region is compared with the volume of the blade 46*c* in that region, the above-described relationship is satisfied.

As a result, similarly as in the First Embodiment, it is possible to compatibly realize ensuring of the developer feeding property and ensuring of the developer stirring property of the second screw 46B. Particularly, in this embodiment, the second screw 46B is the two-thread screw, and the single thread blade 46Bb has a shape continuous in the axial direction and a remaining single thread blade 46Bb has a shape in which the gap portion 46Bg is provided. In the case of such a constitution, the volume of the blade 46Bb may preferably be made not more than 75% of the volume of the blade 46Ba.

This is because compared with the three-thread screw as in the First Embodiment, in the two-thread screw smaller in number of threads than the three-thread screw, the feeding property of the developer by the continuous-shaped blade 46Ba provided with no gap portion is lower than that in the case where two continuous-shaped blades (threads) are provided. Accordingly, when the volume of the gap portion 46Bg of the remaining single thread blade 46Bb is increased, the developer feeding property is not readily ensured sufficiently. Accordingly, in the case of this embodiment, by decreasing the volume of the gap portion 46Bg of the blade 46Bb, the feeding property of the developer by the blade 46Ba is enhanced, so that the developer feeding property as an entirety of the second screw 46B is ensured.

On the other hand, in the case of this embodiment different from the three-thread screw of the First Embodiment, the continuous-shaped blade 46Ba has the single thread, and therefore, even when the volume of the gap portion 46Bg of the remaining single thread blade 46Bb is small, the developer stirring property can be sufficiently ensured. According to study of the present inventor, in the case of the second screw 46B as in this embodiment, it turned out that by making the volume of the blade 46Bb not more than 75% of the volume of the blade 46Ba, the developer stirring property can be further sufficiently ensured while ensuring the developer feeding property. Incidentally, in the case of the two-thread screw, the volume of the blade 46Bb may preferably be made 50% or more and 75% or less of the volume of the blade 46Ba.

Incidentally, in the above, the blade 46Bb is provided with the gap portion 46Bg in a region corresponding to the pitch of 45° with respect to the rotational direction of the second screw 46B. However, positions, phases and periodicity of the gap portions 461*g* and 462*g* with respect to the longitudinal direction can be arbitrarily set when the volume ratio of the gap portion 46Bg is not less than 25%. Further, the blade 46Bb may also be formed so that the shape thereof is not the continuous shape but is provided with a gap portion having a volume smaller than the volume of the gap portion 46Bg in the entire region with respect to the axial direction as in the case of the blade 46Aa of Second Embodiment. The volume ratio of the gap portion in this case is less than 25%.

Fourth Embodiment

Figure 10:
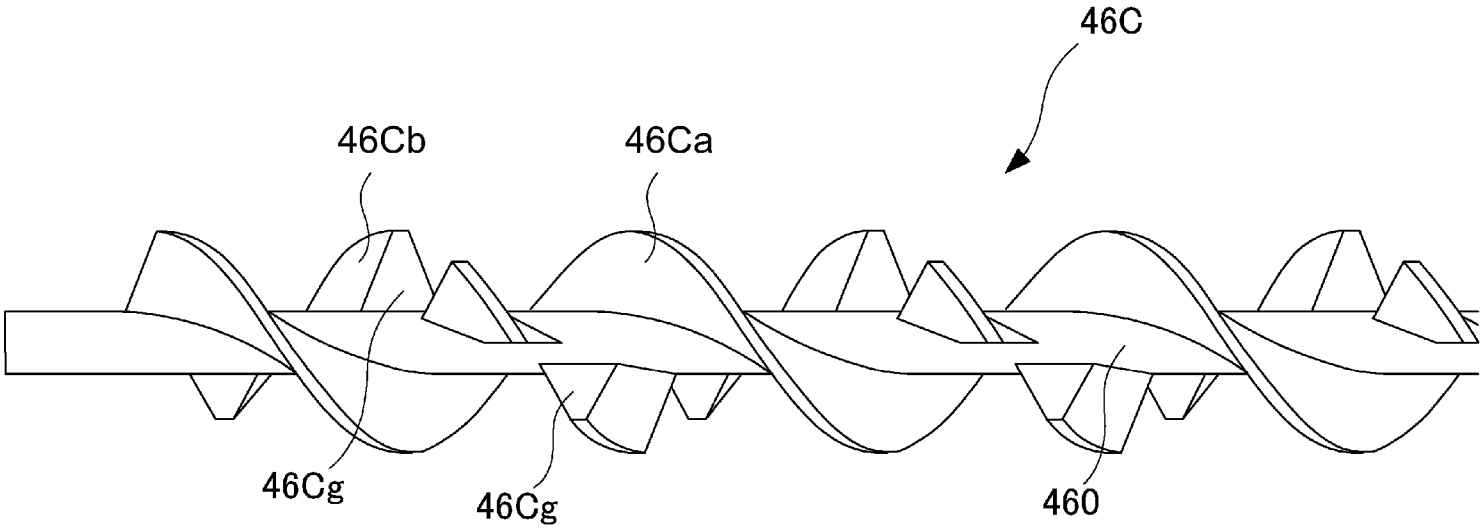
FIG. 10 is a schematic view showing a part of a second screw according to a Fourth Embodiment.

The Fourth Embodiment will be described using FIG. 10 while making reference to FIGS. 2 and 3. A second screw 46C of this embodiment is a screw for feeding the developer in the stirring chamber 48 while stirring the developer similarly as in the Third Embodiment and includes two blades (threads) 46Ca and 46Cb helically formed around the rotation shaft 460. However, different from the Third Embodiment, a phase of a gap portion 46Cg of the blade 46Cb is different from that in the Third Embodiment. Other constitution and actions are similar to those in the above-described Third Embodiment. In the following, constituent elements similar to those in the Third Embodiment will be omitted from description and illustration or will be briefly described, and in the following, a portion different from the Third Embodiment will be principally described.

The second screw 46C is a two-thread screw including the two blades (threads) 46Ca and 46Cb. Further, of these blades (threads) 46C and 46Cb, the blade 46C (first blade) has a shape continuous over the axial direction of the rotation shaft 460, and the blade 46Cb (second blade) is provided, at least a part with respect to the axial direction of the rotation shaft 460, with a gap portion 46Cg.

Further, the second screw 46C is constituted so that a volume of the blade 46Cb with respect to the axial direction thereof is 50% of a volume of the blade 46Ca with respect to the axial direction thereof. In other words, a volume ratio obtained by dividing a volume of the gap portion 46Cg occupied in an entire region of the second screw 46C with respect to the axial direction by a similar volume of the blade 46Cb and the gap portion 46Cg occupied in the entire region of the second screw 46B with respect to the axial direction is made 50%. Incidentally, the volume of the gap portion is a volume of a phantom blade portion formed at the gap portion on assumption that the blade has a continuous shape.

The blade 46Cb of such a second screw 46C is formed so that the gap portion 46Cg is formed periodically over an entire region of the axial direction. In this embodiment, the blade 46Cb and the gap portion 46Cg are formed so as to alternately exist every 45° with respect to a phase of the second screw 46C along the rotational direction of the second screw 46C. Accordingly, in the case where a portion of the blade 46Cb is viewed in the axial direction through one-full circumference, the blade 46Cb and the gap portion 46Cg alternately exist in an amount corresponding to the same phases. Accordingly, when the portion of the blade 46Cb is projected in the axial direction through one-full circumference, an areal ratio between the blade 46Cb and the gap portion 46Cg is 1:1.

As a result, the volume of the blade 46Cb is made 50% of the volume of the blade 46Ca. A volume ratio of the gap portion 46Cg per (one) pitch in the blade 46Cb (i.e., (volume of gap portion)/{(volume of blade)+(volume of gap portion)} is also 50%.

Incidentally, in the above, in order to make the volume of the blade 46Cb 50% of the volume of the blade 46Ca, the blade 46Cb and the gap portion 46Cg were alternately and periodically disposed every pitch of 45°. However, the phases of the blade and the gap portion may also be those other than the above-described phase and the blade and the gap portion may also be not periodically disposed.

Fifth Embodiment

Figure 11:
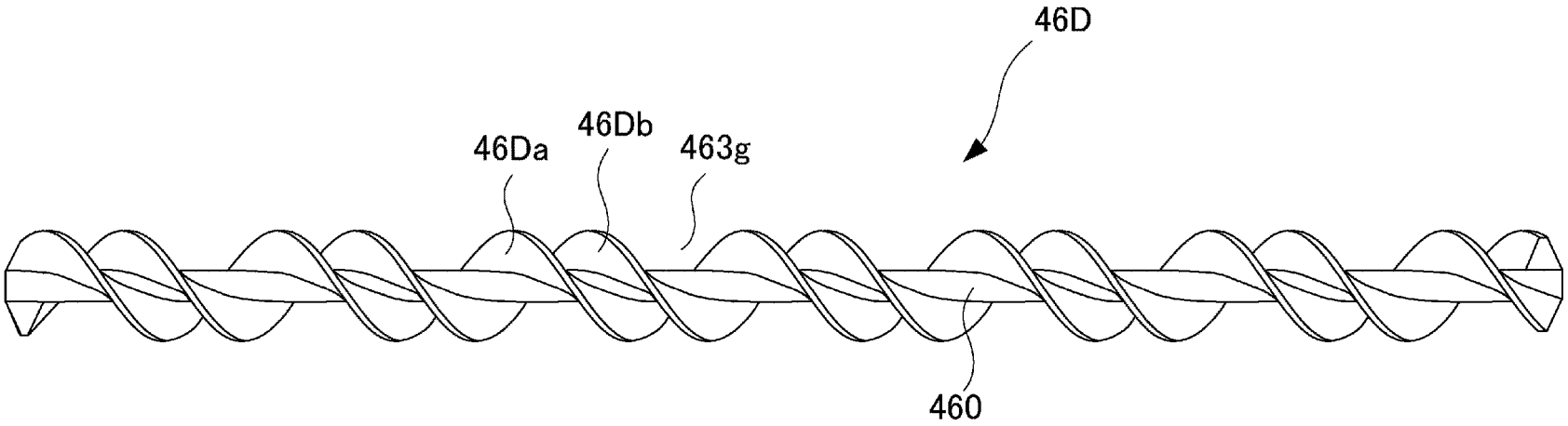
FIG. 11 is a schematic view showing a part of a second screw according to a Fifth Embodiment.

The Fifth Embodiment will be described using FIG. 11 while making reference to FIGS. 2 and 3. A second screw 46D of this embodiment is a screw for feeding the developer in the stirring chamber 48 while stirring the developer similarly as in the First Embodiment. However, different from the First Embodiment, two blades (threads) 46Da and 46Db helically formed on the rotation shaft 460 are provided. Other constitution and actions are similar to those in the above-described First Embodiment. In the following, constituent elements similar to those in the First Embodiment will be omitted from description and illustration or will be briefly described, and in the following, a portion different from the First Embodiment will be principally described.

The second screw 46D is a two-thread screw including the two blades (threads) 46Da and 46Db.

The second screw 46D is a two-thread screw including two blades (threads) 46Da and 46Db. Further, the two blades (threads) 46Da and 46Db have a continuous shape over the axial direction of the rotation shaft 460. However, a gap (interval) between one blade 46Da and the other blade 46Db adjacent to the one blade 46Da on one side of the rotation shaft 460 with respect to the axial direction is different from a gap (interval) between the other blade 46Db and the one blade 46Da adjacent to the other blade 46Db on the one side of the rotation shaft 460 with respect to the axial direction. Incidentally, in this embodiment, a constitution in which such two blade portions are formed on a part of the rotation shaft 460 with respect to the axial direction may also be employed.

In other words, the second screw 46D has a shape such that a single thread blade is removed on the assumption that the second screw 46D is a three-thread screw including three blades (threads) having the same pitch. Further, the second screw 46D corresponds to a screw in which of the three blades (threads), a volume of a gap portion of the single thread blade is made 100%. Accordingly, with respect to the developer feeding direction of the second screw 46D, a gap between the blade 46Db and the blade 46Da disposed downstream of the blade 46Db is larger than a gap between the blade 46Da and the blade 46Db disposed downstream of the blade 46Da. This portion having a large gap is a gap portion 463*g*.

Also in such a case of this embodiment, similarly as in the First Embodiment, it is possible to compatibly realize ensuring of the developer feeding property and ensuring of the developer stirring property of the second screw 46D. That is, the two blades (threads) 46Da and 46Db have a continuous shape over the axial direction, and therefore, the developer feeding property can be ensured by these two blades (threads) 46Da and 46Db. On the other hand, the gap (gap portion 463*g*) between the blade 46Db and the blade 46Da disposed downstream of the blade 46Db is larger than the gap between the blade 46Da and the blade 46Db disposed upstream of the blade 46Da, and therefore, stagnation of the developer generates at the gap portion 463*g* which is a portion having a large gap, so that stirring of the developer at the gap portion 463*g* is promoted. For this reason, also the stirring property can be ensured.

Incidentally, in the case of this embodiment, both the two blades (threads) 46Da and 46Db have the continuous shape, but the above-described gap portion as in the above-described embodiments may also be formed on at least one of the blades. In this case, a volume of the gap portion in an entire region of the screw with respect to the axial direction may preferably be less than 25% of a volume of the blade and the gap portion in the entire region of the screw with respect to the axial direction.

Other Embodiments

The gap portions described in the above-described embodiments may only be required to be portions where the blade is discontinuous, and for example, between the adjacent portions of the blade 46*c* with respect to a direction along a helix in FIG. 5, a blade having an outer diameter smaller than the outer diameter of the blade 46*c* may also exist. That is, a part of an outer peripheral surface of the blade continuous in the axial direction is cut away at a part of the axial direction, and this cut-away portion may also be used as the gap portion. In summary, the present invention also includes the case such that a blade-free portion where components of a flow of the developer generate along the feeding direction and the stirring direction at a part of the blade with respect to the axial direction corresponds to the gap portion, and the gap portion includes not only the case where the blade is completely removed but also the case where the blade partly remains.

In the above-described embodiments, the shape such that of the plurality of blades (threads), at least one blade (thread) is provided with the gap portion or is omitted (removed) was described. However, the present invention may also employ a constitution other than the above-described constitutions when in the constitution, a fifth blade having at least one thread is higher in developer feeding force than (another) sixth blade having at least one thread and the sixth blade is higher in developer stirring force than the fifth blade. For example, of the three blades (threads), one blade (chamber) is lower in feeding force than other two blades (threads) but is higher in stirring force than other two blades (threads) by changing an outer diameter, a pitch or a blade angle of the one blade (thread) relative to the other two blades (threads).

In the above-described embodiments, the two-thread screw or the three-thread screw were described as the screw including a plurality of blades (threads), but the present invention is also applicable to screws including four or more threads when the relationship between the volumes of the gap portion and the blade is one of the above-described relationships. As in the Fifth Embodiment, also the constitution in which the gaps between adjacent blades are different from each other is also applicable to a multiple-thread screw providing three or more threads.

In the above-described embodiments, the constitution in which the image forming apparatus was the printer was described, but the present invention is also applicable to a copying machine, a facsimile machine, a multi-function machine and the like. Further, in the above-described embodiments, as the developing device, the constitution in which the developer is supplied from the developing chamber to the developing sleeve and is collected from the developing sleeve into the developing chamber was described. However, the present invention is also applicable to a constitution in which the developer is supplied from the developing chamber (first chamber) and is collected in the stirring chamber (second chamber) provided while sandwiching the partition wall between itself and the developing chamber. Further, other than the developing device in which the first chamber and the second chamber are disposed and arranged in the horizontal direction, the present invention is applicable to constitutions such that the first chamber and the second chamber exist in a positional relationship that the first chamber and the second chamber are disposed along an up-down direction or are disposed so as to be inclined with respect to the horizontal direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-100861 filed on May 22, 2017, which is hereby incorporated by reference herein in its entirety.

What is claimed is:

1. A feeding screw for feeding a developer, comprising:
a rotation shaft; and
a helical blade provided on said rotation shaft and including a plurality of threads,
wherein said helical blade includes,
a first blade helically formed with a single thread on said rotation shaft,
a second blade helically formed with a single thread on said rotation shaft, and
a third blade helically formed with a single thread on said rotation shaft,
wherein with respect to a direction along said rotation shaft, a gap is provided between a most downstream end portion of said second blade and a most upstream end portion of said third blade, and
wherein a volume of said second blade is not more than 75% of said first blade between a most upstream end portion of said second blade and the most upstream end portion of said third blade with respect to the direction.

2. A feeding screw according to claim 1,
wherein the volume of the second blade is not more than 50% of said first blade between the most upstream end portion of said second blade and the most upstream end portion of said third blade with respect to the direction.

3. A feeding screw according to claim 1, wherein a pitch of said second blade and a pitch of said third blade are equal to each other.

4. A feeding screw according to claim 1, wherein a pitch of said first blade, a pitch of said second blade, and a pitch of said third blade are equal to each other.

5. A feeding screw according to claim 1, wherein an outer diameter of said second blade and an outer diameter of said third blade are equal to each other.

6. A feeding screw according to claim 1, wherein an outer diameter of said first blade, an outer diameter of said second blade, and an outer diameter of said third blade are equal to each other.

7. A developing device comprising:

(i) a developer carrying member configured to carry a developer containing toner and a carrier;

(ii) a first chamber configured to accommodate the developer supplied to said developer carrying member;

(iii) a second chamber configured to accommodate the developer for being circulated between itself and said first chamber; and (iv) a developing screw provided in said second chamber and configured to feed, wherein said developing screw includes, (iv-i) a rotation shaft; and (iv-ii) a helical blade provided on said rotation shaft and including a plurality of threads, wherein said helical blade includes, (iv-ii-i) a first blade helically formed with a single thread on said rotation shaft, (iv-ii-ii) a second blade helically formed with a single thread on said rotation shaft, and (iv-ii-iii) a third blade helically formed with a single thread on said rotation shaft, wherein with respect to a developer feeding direction of said developing screw, a gap is provided between a most downstream end portion of said second blade and a most upstream end portion of said third blade, and wherein a volume of said second blade is not more than 75% of said first blade between a most upstream end portion of said second blade and the most upstream end portion of said third blade with respect to the direction.

8. A developing device according to claim 7, wherein the volume of the second blade is not more than 50% of said first blade between the most upstream end portion of said second blade and the most upstream end portion of said third blade with respect to the direction.

9. A developing device according to claim 7, wherein a pitch of said second blade and a pitch of said third blade are equal to each other.

10. A developing device according to claim 7, wherein a pitch of said first blade, a pitch of said second blade, and a pitch of said third blade are equal to each other.

11. A developing device according to claim 7, wherein an outer diameter of said second blade and an outer diameter of said third blade are equal to each other.

12. A developing device according to claim 7, wherein an outer diameter of said first blade, an outer diameter of said second blade, and an outer diameter of said third blade are equal to each other.

13. A developing device according to claim 7, further comprising a toner content detecting portion provided in said second chamber and configured to detect a content of the toner to the developer, wherein with respect to the developer feeding direction, said second blade is provided upstream of said toner content detecting portion, and said third blade is provided upstream of said supplying portion.

14. A developing device according to claim 7, further comprising a supplying portion configured to externally supply the developer to said second chamber, wherein with respect to the developer feeding direction, said second blade is provided downstream of said supplying portion, and said third blade is provided upstream of said supplying portion.

15. A feeding screw for feeding a developer comprising:

a rotation shaft;

a first blade portion helically formed on an outer peripheral surface of said rotation shaft and configured to feed the developer in one direction, a second blade portion helically formed on the outer peripheral surface of said rotation shaft and configured to feed the developer in said one direction, and a third blade portion helically formed on the outer peripheral surface of said rotation shaft and configured to feed the developer in said one direction, wherein when said feeding screw is seen in a direction perpendicular to a rotational axis thereof, said first blade portion and said second blade portion overlap with each other, said second blade portion and said third blade portion do not overlap with each other, and said third blade portion and said first blade portion overlap with each other, and wherein a proportion of a sum of an area of a cross-section perpendicular to said rotation shaft of said second blade portion and an area of a cross-section perpendicular to said rotation shaft of said third blade portion to an area of a cross-section perpendicular to said rotation shaft of said first blade portion is larger than zero and 75% or less.

16. A feeding screw according to claim 15, wherein the proportion of the sum of the area of the cross-section perpendicular to said rotation shaft of said second blade portion and the area of the cross-section perpendicular to said rotation shaft of said third blade portion to the area of the cross-section perpendicular to said rotation shaft of said first blade portion is larger than zero and 50% or less.

17. A feeding screw according to claim 15, wherein an outer diameter of said first blade portion and an outer diameter of said second blade portion are equal to each other.

18. A feeding screw according to claim 15, wherein an outer diameter of said first blade portion, an outer diameter of said second blade portion, and an outer diameter of said third blade portion are equal to each other.

19. A feeding screw according to claim 15, wherein a pitch of said second blade portion and a pitch of said third blade portion are equal to each other.

20. A feeding screw according to claim 15, wherein a pitch of said first blade portion, a pitch of said second blade portion, and a pitch of said third blade portion are equal to each other.

21. A developing device comprising:

a developer carrying member configured to carry a developer containing toner and a carrier in order to develop an electrostatic latent image formed on an image bearing member;

a developing container including a first chamber configured to supply the developer to said developer carrying member, a second chamber partitioned from said first chamber by a partition wall, a first communication portion configured to permit communication of the developer from said first chamber to said second chamber, and a second communication portion configured to permit communication of the developer from said second chamber to said first chamber;

a first feeding screw provided in said first chamber and configured to feed the developer in a first direction from said second communication portion to said first communication portion; and a second feeding screw provided in said second chamber and configured to feed the developer in a second direction from said first communication portion to said second communication portion;

wherein said second feeding screw includes, a rotation shaft;

a first blade portion helically formed on an outer peripheral surface of said rotation shaft and configured to feed the developer in the second direction, a second blade portion helically formed on the outer peripheral surface of said rotation shaft and configured to feed the developer in the second direction, and a third blade portion helically formed on the outer peripheral surface of said rotation shaft and configured to feed the developer in the second direction, wherein when said second feeding screw is seen in a direction perpendicular to a rotational axis thereof, said first blade portion and said second blade portion overlap with each other, said second blade portion and said third blade portion do not overlap with each other, and said third blade portion and said first blade portion overlap with each other, and wherein a proportion of a sum of an area of a cross-section perpendicular to said rotation shaft of said second blade portion and an area of a cross-section perpendicular to said rotation shaft of said third blade portion to an area of a cross-section perpendicular to said rotation shaft of said first blade portion is larger than zero and 75% or less.

22. A developing device according to claim 21, wherein the proportion of the sum of the area of the cross-section perpendicular to said rotation shaft of said second blade portion and the area of the cross-section perpendicular to said rotation shaft of said third blade portion to the area of the cross-section perpendicular to said rotation shaft of said first blade portion is larger than zero and 50% or less.

23. A developing device according to claim 21, wherein an outer diameter of said first blade portion and an outer diameter of said second blade portion are equal to each other.

24. A developing device according to claim 21, wherein an outer diameter of said first blade portion, an outer diameter of said second blade portion, and an outer diameter of said third blade portion are equal to each other.

25. A developing device according to claim 21, wherein a pitch of said second blade portion and a pitch of said third blade portion are equal to each other.

26. A developing device according to claim 21, wherein a pitch of said first blade portion, a pitch of said second blade portion, and a pitch of said third blade portion are equal to each other.

27. A developing device according to claim 21, further comprising a developer supplying portion provided in said second chamber and configured to supply the developer into said developing container, wherein with respect to the second direction, said second blade portion is provided downstream of said developer supplying portion, and wherein with respect to the second direction, said third blade portion is provided downstream of said developer supplying portion.

28. A developing device according to claim 21, further comprising a toner content detecting portion provided in said second chamber and configured to detect a toner content of the developer in said developing container, wherein with respect to the second direction, said second blade portion is provided upstream of said toner content detecting portion, and wherein with respect to the second direction, said third blade portion is provided upstream of said toner content detecting portion.

29. A developing device according to claim 21, further comprising, a developer supplying portion provided in said second chamber and configured to supply the developer into said developing container, and a toner content detecting portion provided in said second chamber and configured to detect a toner content of the developer in said developing container, wherein with respect to the second direction, said second blade portion is provided downstream of said developer supplying portion and upstream of said toner content detecting portion, and wherein with respect to the second direction, said third blade portion is provided downstream of said developer supplying portion and upstream of said toner content detecting portion.

30. A feeding screw for feeding a developer comprising:

a rotation shaft;

a first blade portion helically formed on an outer peripheral surface of said rotation shaft and configured to feed the developer in one direction, a second blade portion helically formed on the outer peripheral surface of said rotation shaft and configured to feed the developer in said one direction, and a third blade portion helically formed on the outer peripheral surface of said rotation shaft and configured to feed the developer in said one direction, wherein a proportion of a sum of an area of a cross-section perpendicular to said rotation shaft of said second blade portion and an area of a cross-section perpendicular to said rotation shaft of said third blade portion to an area of a cross-section perpendicular to said rotation shaft of said first blade portion is larger than zero and 50% or less.

31. A feeding screw according to claim 30, wherein an outer diameter of said first blade portion and an outer diameter of said second blade portion are equal to each other.

32. A feeding screw according to claim 30, wherein an outer diameter of said first blade portion, an outer diameter of said second blade portion, and an outer diameter of said third blade portion are equal to each other.

33. A feeding screw according to claim 30, wherein a pitch of said second blade portion and a pitch of said third blade portion are equal to each other.

34. A feeding screw according to claim 30, wherein a pitch of said first blade portion, a pitch of said second blade portion, and a pitch of said third blade portion are equal to each other.

35. A developing device comprising:

a developer carrying member configured to carry a developer containing toner and a carrier in order to develop an electrostatic latent image formed on an image bearing member;

a developing container including a first chamber configured to supply the developer to said developer carrying member, a second chamber partitioned from said first chamber by a partition wall, a first communication portion configured to permit communication of the developer from said first chamber to said second chamber, and a second communication portion configured to permit communication of the developer from said second chamber to said first chamber;

a first feeding screw provided in said first chamber and configured to feed the developer in a first direction from said second communication portion to said first communication portion; and a second feeding screw provided in said second chamber and configured to feed the developer in a second direction from said first communication portion to said second communication portion;

wherein said second feeding screw includes, a rotation shaft;

a first blade portion helically formed on an outer peripheral surface of said rotation shaft and configured to feed the developer in the second direction, a second blade portion helically formed on the outer peripheral surface of said rotation shaft and configured to feed the developer in the second direction, and a third blade portion helically formed on the outer peripheral surface of said rotation shaft and configured to feed the developer in the second direction, wherein when said second feeding screw is seen in a direction perpendicular to a rotational axis thereof, said first blade portion and said second blade portion overlap with each other, said second blade portion and said third blade portion do not overlap with each other, and said third blade portion and said first blade portion overlap with each other, and wherein a proportion of a sum of an area of a cross-section perpendicular to said rotation shaft of said second blade portion and an area of a cross-section perpendicular to said rotation shaft of said third blade portion to an area of a cross-section perpendicular to said rotation shaft of said first blade portion is larger than zero and 50% or less.

36. A developing device according to claim 35, wherein an outer diameter of said first blade portion and an outer diameter of said second blade portion are equal to each other.

37. A developing device according to claim 35, wherein an outer diameter of said first blade portion, an outer diameter of said second blade portion, and an outer diameter of said third blade portion are equal to each other.

38. A developing device according to claim 35, wherein a pitch of said second blade portion and a pitch of said third blade portion are equal to each other.

39. A developing device according to claim 35, wherein a pitch of said first blade portion, a pitch of said second blade portion, and a pitch of said third blade portion are equal to each other.

40. A developing device according to claim 35, further comprising a developer supplying portion provided in said second chamber and configured to supply the developer into said developing container, wherein with respect to the second direction, said second blade portion is provided downstream of said developer supplying portion, and wherein with respect to the second direction, said third blade portion is provided downstream of said developer supplying portion.

41. A developing device according to claim 35, further comprising a toner content detecting portion provided in said second chamber and configured to detect a toner content of the developer in said developing container, wherein with respect to the second direction, said second blade portion is provided upstream of said toner content detecting portion, and wherein with respect to the second direction, said third blade portion is provided upstream of said toner content detecting portion.

42. A developing device according to claim 35, further comprising, a developer supplying portion provided in said second chamber and configured to supply the developer into said developing container, and a toner content detecting portion provided in said second chamber and configured to detect a toner content of the developer in said developing container, wherein with respect to the second direction, said second blade portion is provided downstream of said developer supplying portion and upstream of said toner content detecting portion, and wherein with respect to the second direction, said third blade portion is provided downstream of said developer supplying portion and upstream of said toner content detecting portion.

* * * * *